US010139193B2

(12) United States Patent
Iwasawa

(10) Patent No.: US 10,139,193 B2
(45) Date of Patent: Nov. 27, 2018

(54) DISPLACEMENT SYSTEM FOR MOTOR ATTACHMENT ANGLE IN SIMULATION GUN

(71) Applicant: TOKYO MARUI CO, LTD., Tokyo (JP)

(72) Inventor: Iwao Iwasawa, Tokyo (JP)

(73) Assignee: TOKYO MARUI CO., LTD., Tokyo (JP)

( * ) Notice: Subject to any disclaimer, the term of this patent is extended or adjusted under 35 U.S.C. 154(b) by 0 days.

(21) Appl. No.: 15/560,574

(22) PCT Filed: Mar. 24, 2015

(86) PCT No.: PCT/JP2015/058938
§ 371 (c)(1),
(2) Date: Sep. 22, 2017

(87) PCT Pub. No.: WO2016/151767
PCT Pub. Date: Sep. 29, 2016

(65) Prior Publication Data

US 2018/0045483 A1 Feb. 15, 2018

(51) Int. Cl.
*F41B 11/643* (2013.01)
*F41B 11/71* (2013.01)
*F41B 11/646* (2013.01)

(52) U.S. Cl.
CPC ..... *F41B 11/643* (2013.01); *F41B 11/646* (2013.01); *F41B 11/71* (2013.01)

(58) Field of Classification Search
CPC ..... F41B 11/643; F41B 11/646; F41B 11/71; F41B 11/60; F41B 11/64; F41B 11/642; F41B 11/647
(Continued)

(56) References Cited

U.S. PATENT DOCUMENTS 7,305,980 B2 * 12/2007 Liao ..... F41A 19/10 124/31
2003/0098019 A1 5/2003 Hu
(Continued)

FOREIGN PATENT DOCUMENTS

JP 3110020 4/2005
JP 3118822 2/2006
(Continued)

OTHER PUBLICATIONS

International Search Report dated Jun. 16, 2015.

*Primary Examiner* — John Cooper
(74) *Attorney, Agent, or Firm* — Jacobson Holman, PLLC.

(57) ABSTRACT

A system where an attachment angle between an output gear of a motor holder and an input gear of a gear box is displaceable. A piston cylinder mechanism is driven by an electric mechanism. An output gear and input gear are bevel gears. Connection portions are provided in at least two places on a gear box side, and connection counterpart portions are provided on a motor holder side. The connection portions are present on the same circumference about a rotary shaft of the input gear and on both sides across a radial-directional axial line passing through the rotary shaft and angles A, B formed by axial lines respectively connecting the connection portions. The rotary shaft and the radial-directional axial line are set so as not to be equal to each other (A≠B).

3 Claims, 14 Drawing Sheets

(58) Field of Classification Search
USPC ..... 124/63, 64, 66, 67, 69, 70, 71, 73, 75, 124/76, 77
See application file for complete search history.

(56) References Cited

U.S. PATENT DOCUMENTS

| | | | | |
|---|---|---|---|---|
| 2009/0235911 | A1* | 9/2009 | Klarborg | F41B 11/646 124/66 |
| 2011/0315134 | A1* | 12/2011 | Tsai | F41B 11/643 124/56 |
| 2014/0224235 | A1* | 8/2014 | Liao | F41A 11/00 124/32 |

FOREIGN PATENT DOCUMENTS

| | | |
|---|---|---|
| JP | 2006300462 | 11/2006 |
| JP | 2009138979 | 6/2009 |
| JP | 3179041 | 9/2012 |

* cited by examiner

DISPLACEMENT SYSTEM FOR MOTOR ATTACHMENT ANGLE IN SIMULATION GUN

TECHNICAL FIELD

The present invention relates to a system in which an attachment angle of an output gear of a motor holder configuring an electric mechanism with respect to an input gear of a gear box is displaceable in a simulation gun in which a piston cylinder mechanism is driven by the electric mechanism and a bullet is shot with generated compressed air.

BACKGROUND ART

Simulation guns include so-called electric guns, and the electric guns each generally have a configuration in which a piston cylinder mechanism is driven by an electric mechanism and a bullet is shot with generated compressed air. The electric mechanism is configured to have a motor and a gear box which decelerates the rotation speed of the motor. In most of cases, an output gear provided on a motor side and an input gear provided on a gear box side sire joined to each other by employing bevel gears which are suitable for driving precision machines.

There is a demand that the output gear provided on the motor side and the input gear provided on the gear box side are minimized in backlash, so that each thereof is fixed so as to retain high precision. JP-A-2006-300462 and the like disclose configurations as examples of such a technology in the related art, in which the motor side having the output gear and the gear box side having the input gear are disposed and fixed as necessary for each type. Therefore, an electric mechanism has to be newly manufactured every time a product is developed.

Therefore, even in a case where a technically meaningful configuration is developed, due to the fixed positional relationship of a motor with respect to a gear box, the configuration can be redeployed if simulation guns are similar to each other in form. Otherwise, the same configuration cannot be shared by a plurality of types. Since the electric mechanism is existentially important for electric guns, the electric mechanism cannot be neglected, sometimes resulting in a so-called shackle in the design thereof. However, no configuration has been proposed which can be shared by simulation guns different from each other in external appearance and which can realize a system of the electric mechanism.

CITATION LIST

Patent Literature

[PTL 1] JP-A-2006-300462

SUMMARY OF INVENTION

Technical Problem

The present invention has been made in consideration of the foregoing points, and an object thereof is to provide a displacement system in which a positional relationship between a motor side having an output gear and a gear box side having an input gear can be changed to a different positional relationship with high precision. In addition, another object of the present invention is to provide a configuration in which the output gear and the input gear are constituted by bevel gears, and angles formed by axial lines respectively connecting connection portions and a rotary shaft of the input gear before and sifter a displacement, and a radial-directional axial line are angles A, B which are not equal to each other (A≠B), so that the displacement for a plurality of angles can be easily selected.

Solution to Problem

In order to attain the above-described objects, according to the present invention, there is provided means for a displacement system for a motor attachment angle, in which am attachment angle of an output gear of a motor holder configuring an electric mechanism with respect to an input gear of gear box is displaceable, in a simulation gun in which a piston cylinder mechanism is driven by the electric mechanism and a bullet is shot with generated compressed air. The output gear and the input gear are constituted by bevel gears. The system includes connection portions that are provided in at least two places on a gear box side, and connection counterpart portions that respectively coincide with the connection portions and are provided on a motor holder side. The connection portions are present on the same circumference about a rotary shaft of the input gear and on both sides across a radial-directional axial line passing through the rotary shaft of the input gear, and angles A, B formed by axial lines respectively connecting the connection portions and the rotary shaft of the input gear, and the radial-directional axial line are not equal to each other (A≠B).

The simulation gun at which the present invention is targeted has a configuration in which the piston cylinder mechanism is driven by the electric mechanism and a bullet is shot with compressed air generated as a result thereof. In this regard, the configuration is in common with that of electric guns in the related art. The electric mechanism is configured to have the motor holder and the gear box, and when the output gear on the motor holder side and the input gear on the gear box side are joined to each other, torque required for driving the piston cylinder mechanism is drawn out.

On the motor holder side, the rotator shaft itself may serve as a motor shaft. However, a motor is sometimes a geared motor. The motor holder indicates an element in which a single unit of a motor and a retention function or the like are combined. In addition, the gear box side generally configures a reduction-related gear set. Although the gear box contains a term "box", it is important to configure a gear set regardless of the term, and there is no need to be restricted by the structure of a box. Then, an input shaft of the gear box or the gear set is provided with a first gear.

The output gear and the input gear are constituted by the bevel gears. The two bevel gears are configured to mesh with each other via a right-angle axis. In addition, there may be cases of being configured to mesh with each other via an acute-angle axis or an obtuse-angle axis. For positioning the meshing between the output gear and the input gear, the connection portions are provided in at least two places on the gear box side, and the connection counterpart portions respectively coinciding with the connection portions are provided on the motor holder side.

In the configuration, the connection portions are present on the same circumference about the rotary shaft of the input gear and on both the sides across the radial-directional axial line passing through the rotary shaft of the input gear, and the angles A, B formed by the axial lines respectively connecting the connection portions and the rotary shaft of the input gear, and the radial-directional axial line are not equal to each other (A≠B) (refer to FIG. 9). According to the configuration, the position of the motor holder side shifts with respect to the gear box side by the difference between the angles A, B. Therefore, the connection position can be displaced in two ways, such as a case where the angle A is in a higher level and the angle B is in a lower level, and a case where the angle B is in a higher level and the angle A is in a lower level, with respect to the radial-directional axial line passing through the rotary shaft of the input gear.

Besides, the angular change is based on a case where the orientation of the bevel gear on the gear box side is uniform. In a case where the orientations of the bevel gears are upside down, the connection position can be displaced in four ways. However, descriptions will be given based on a state where the bevel gear on the gear box side has rotary surfaces on the top and bottom surfaces and the radial-directional axial line passing through the rotary shaft of the input gear is horizontal.

According to the present invention, it is preferable to include a third connection portion that serves as another connection portion. It is preferable to have a configuration in which the third connection portion is present on the same circumference as connection portions in two places, and an angle C made by an axial line connecting the third connection portion and the rotary shaft of the input gear and the axial line connecting a second connection portion and the rotary shaft of the input gear is equal to a sum of the angles A, B which are not equal to each other formed by the radial-directional axial lines respectively connecting a first connection portion and the second connection portion and the rotary shaft of the input gear. The first and second connection portions may be any one of the connection portions in two places.

In the example having the third connection portion, the lowest level or the highest level can be selected as the position of the third connection portion. Accordingly, the connection position can be displaced in four ways, and in a case of being upside down, the connection position can be displaced in eight ways in total. However, the position of the motor holder side with respect to the gear box side can be freely selected within a range of 90 degrees, thereby exhibiting high flexibility when developing products.

In addition, the connection counterpart portion is an arc-shaped connection counterpart portion which is formed in a gear box on the same circumference about the rotary shaft of the input gear, and the motor holder is able to be fixed at an arbitrary position in the arc (refer to FIG. 14). In this manner, according to the present invention, a configuration is realized which can be shared by simulation guns different from each other in external appearance and which can realize the system of the electric mechanism.

Advantageous Effects of Invention

Since the present invention is configured and operates as described above, the present invention exhibits the effect of being able to provide the displacement system in which the positional relationship between the motor holder side having the output gear and the gear box side having the input gear can be changed to a different positional relationship with high precision. In addition, according to the present invention, the output gear and the input gear are constituted by the bevel gears, and angles formed by the axial lines respectively connecting the connection portions and the rotary shaft of the input gear before and after a displacement, and the radial-directional axial line are the angles A, B which are not equal to each other (A≠B), so that the displacement for a plurality of angles can be easily selected.

BRIEF DESCRIPTION OF DRAWINGS

FIG. 4 consists of FIGS. 4A and 4B and illustrates the cylinder assembly according to the invention.

FIG. 5 consists of FIGS. 5A, 5B and 5C and illustrates the cylinder assembly according to the invention.

FIG. 10 consists of FIGS. 10A, 10B and 10C and relates to attachment of the motor holder according to the invention.

FIG. 14 consists of FIGS. 14A, 14B and 14C and illustrates another embodiment of a displacement system according to the invention in the same manner.

REFERENCE NUMBERS

10 Compressed Air Generating Unit
11, 12, 13 Barrel
14 Cartridge Portion
15 Sight Mechanism
16 Connection Gasket
17 Trigger
18 Switch

19 Outer Barrel
20 Cylinder Assembly
21, 22, 23 Cylinder
24 Blast Nozzle
26 Front Fixing Member
27 Rear Fixing Member
28 Inter-Nozzle
29 Nozzle Base
30 Piston Assembly
31, 32, 33 Piston
34 Joint Portion
35 Piston Shaft
36 Rack
37 Rod
38 Seal Member
39 Gear Disposition Space
40 Electric Mechanism
41 Output Gear
42 Elastic Member
43 Electric Motor, Motor Unit
44 Pinion
45 Reduction Gear Set
46 Piston Movement Portion
47 Guide Groove
48 Selector
49 Latch Member
50 Cartridge Assembly
51 Magazine
53 Output Gear
54 Input Gear
55 Gear Box
56 Piston Cover
57, 58, 59 Connection Portion (First, Second, Third, Respectively)
60 Rotary Shaft
61, 62 Connection Counterpart Portion
63, 64 Mark
65 Stock
66, 67 Grip
68 Arc-Shaped Connection Counterpart Portion
69 Fastener

DETAILED DESCRIPTION OP THE INVENTION

Figure 1:
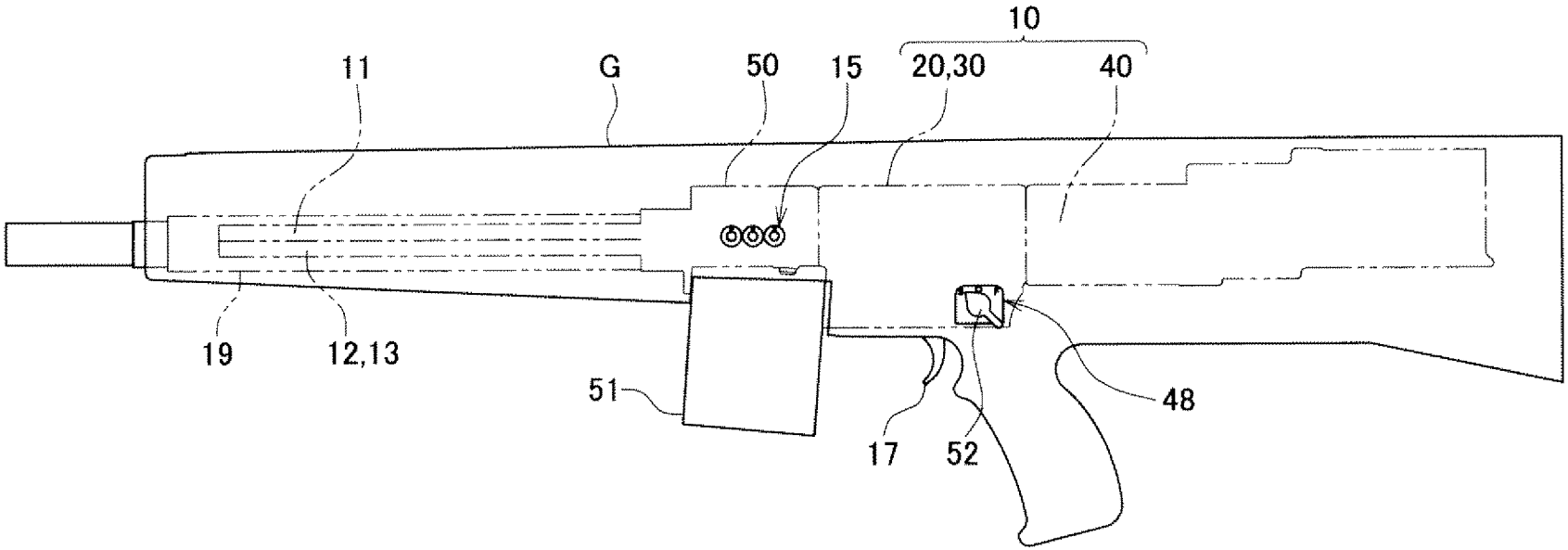
FIG. 1 is a side view illustrating an example of a simulation gun in which a displacement system for a motor attachment angle according to the present invention.

Hereinafter, with reference to the illustrated embodiment, the present invention will be described in more detail. FIG. 1 illustrates an example of a simulation gun in which a displacement system for a motor attachment angle according to the present invention is applied. As a simulation gun G, a multi-bullet shooting electric gun is illustrated. The simulation gun G includes three barrels 11, 12, 13 as an example of a plurality thereof. Therefore, a compressed air generating unit 10 is configured to have a cylinder assembly 20 constituted by three cylinders 21, 22, 23, a piston assembly 30 constituted by three pistons 31, 32, 33, and an electric mechanism 40 driving the piston assembly 30 (refer to FIG. 2 and the like).

A cartridge assembly 50 is provided in a rear portion of the barrels, and a detachable magazine 51 is mounted at a lower portion thereof. A cartridge portion 14 is set in the cartridge assembly 50, so that a bullet B is disposed inside the rear end of each of the three barrels 11, 12, 13. The cartridge portion 14 is provided with a sight mechanism 15 for adjusting a trajectory. In addition, a connection gasket 16 covers the outside of the rear ends of the three barrels 11, 12, 13. The connection gasket 16 is formed of a soft material such as rubber, having seal performance (refer to FIG. 2).

The compressed air generating unit 10 is a part generating air with which the bullet 3 is blasted in order to shoot each bullet B from each of the barrels 11, 12, 13 in the multi-bullet shooting electric gun G. The barrels themselves are combined such that three thereof form a triangle shape when seen from the front. The compressed air generating unit 10 is disposed at the rear inside the electric gun G. The cylinder assembly 20, the piston assembly 30, and the electric mechanism 40 configuring the compressed air generating unit 10 are disposed in an approximately straight line in order thereof.

Figure 3:
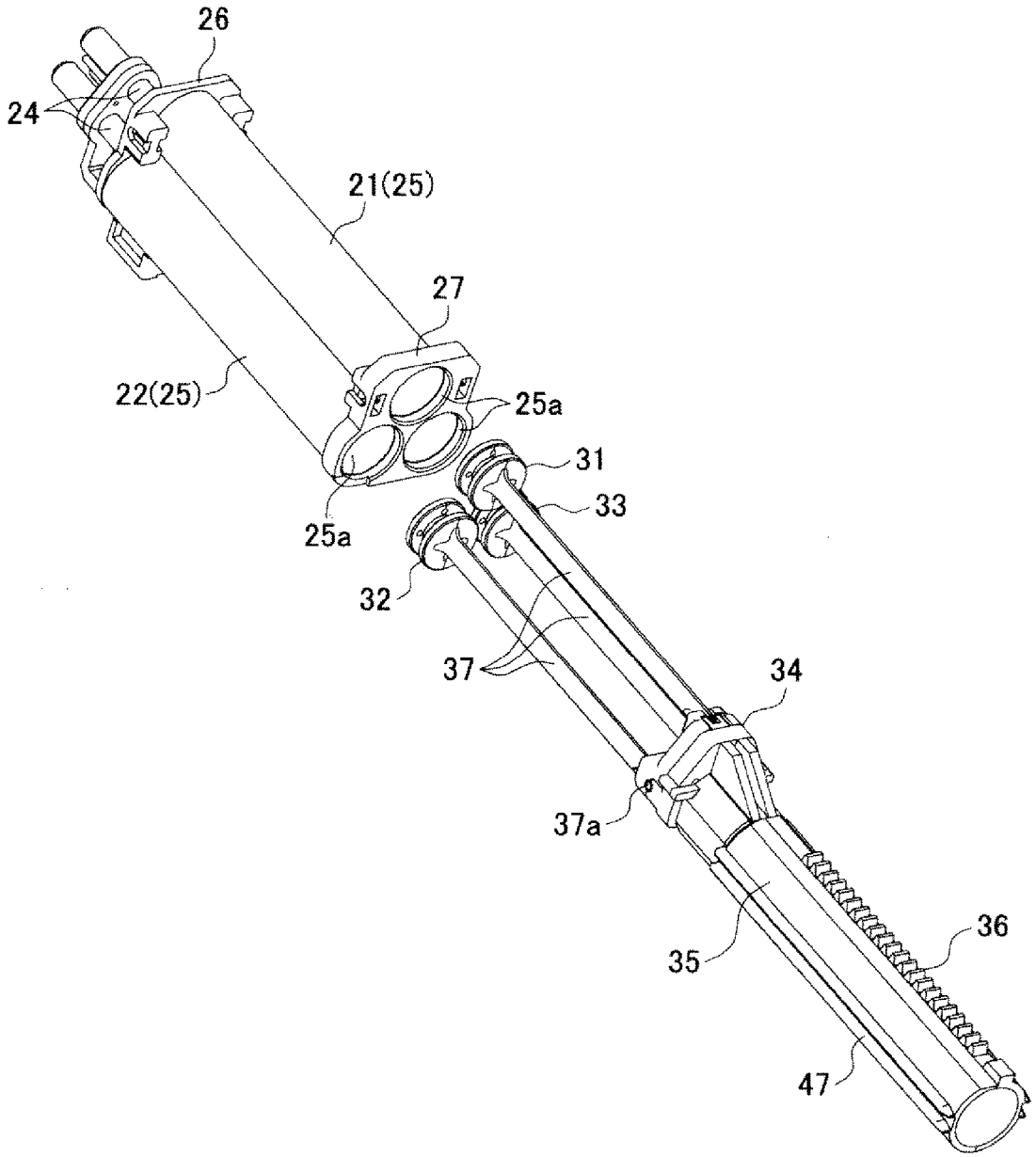
FIG. 3 is an exploded perspective view illustrating a cylinder assembly and a piston assembly according to the invention.
Figure 4A:
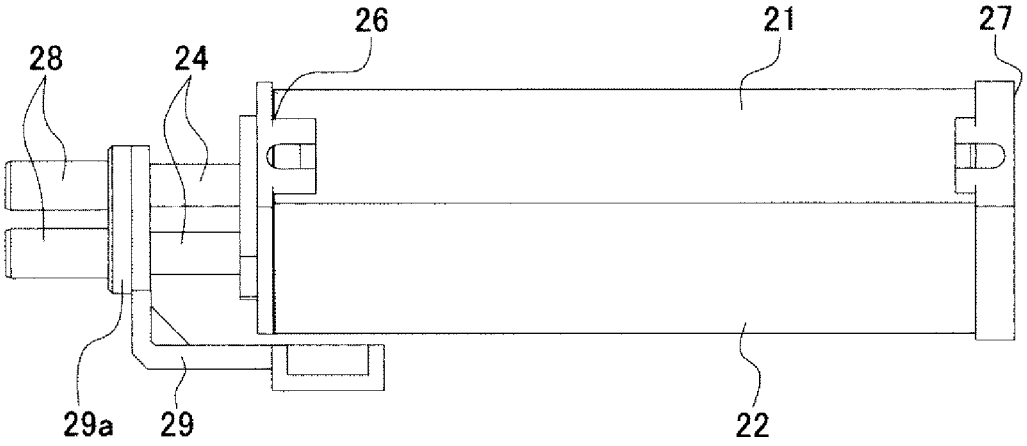
FIG. 4A illustrates a side view.

The cylinder assembly 20 is positioned in a rear portion of the three barrels 11, 12, 13, has air-blast nozzles 24 at the tip end, and has the three cylinders 21, 22, 23 in which the pistons 31, 32, 33 respectively reciprocate. The illustrated cylinder assembly 20 is configured to have three pipe members 25, a front fixing member 26 fixing each of the pipe members 25 to a tip end portion, and a rear fixing member 27 fixing each of the pipe members 25 to a rear end portion (refer to FIGS. 3 and 4).

Figure 4B:
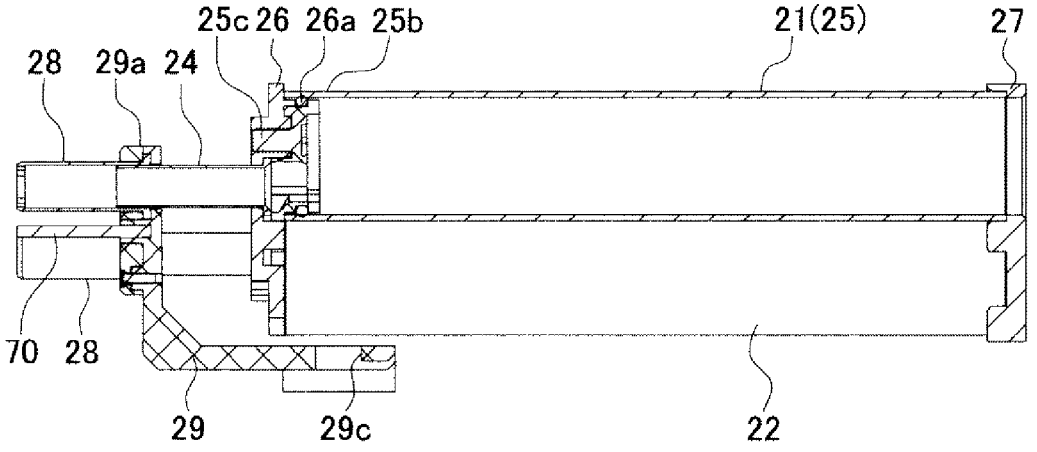
FIG. 4B illustrates a longitudinal sectional view taken along a central line.

The air-blast nozzles 24 are provided in the front fixing member 26, and an insertion port 25*a* for the piston is open in the rear fixing member 27. The blast nozzles 24 are provided in front of a pipe attachment member 25*b*, and the pipe attachment member 25*b* is attached to the rear surface of the front fixing member 26 by a fastener 25*c*. The pipe attachment member 25*b* has a positional relationship with the pipe member 25 in which the pipe attachment member 25*b* is fitted, and is assembled in an air-tight manner by using seal means 26*a* (FIG. 4B).

As seen in the illustrated embodiment, an inter-nozzle 28 is disposed between the cartridge portion 14 and the air-blast nozzles 24. The inter-nozzle 28 is provided to be movable in the forward-rearward direction by a nozzle base 29. The inter-nozzle 28 slides with respect to the blast nozzle 24 in an air-tight manner and is at a position where a bullet is blasted with compressed air generated in the compressed air generating unit 10. The inter-nozzle 28 is attached to an erected portion 29*a* of the nozzle base 29 and is incorporated in a main body of the simulation gun G so as to be able to advance and retract. Thus, in the device of the invention of this application, the nozzle is configured to have the blast nozzle 24 and the inter-nozzle 28, and the inter-nozzle 28 corresponds to the nozzle to which an operation of a movable portion is transmitted.

Figure 2:
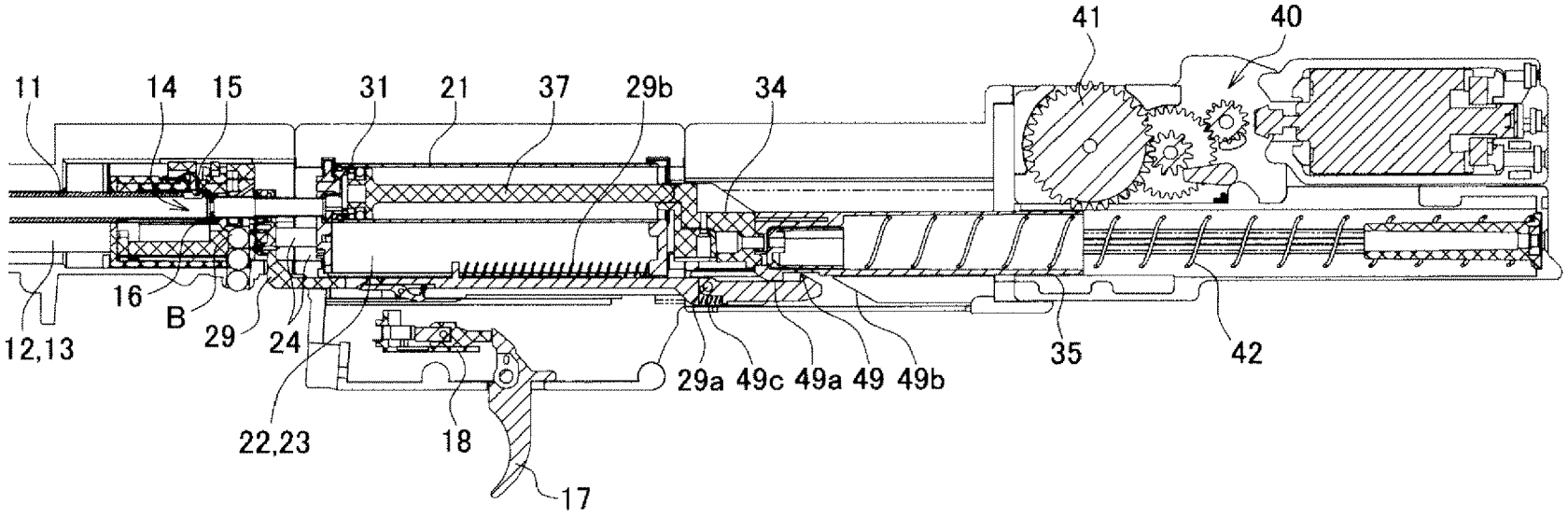
FIG. 2 is a sectional view illustrating an enlarged main portion of the simulation gun according to the invention.

Therefore, the inter-nozzle 28 retracts by being engaged with a latch member 49, in response to retract operations of the pistons 31, 32, 33 and is caused to advance by a spring of biasing means 29*b* acting on the nozzle base 29 (refer to FIG. 2). Then, the tip end thereof is configured to also slide with respect to the connection gasket 16 in an air-tight manner, to be separated from the connection gasket 16, and to retract so as to open a gap, that is, a bullet supply port in which the bullet B is pushed up in the rear end portion of the barrel. Thereafter, the inter-nozzle 28 advances so as to push the bullet B into the cartridge portion 14.

Figure 5A:
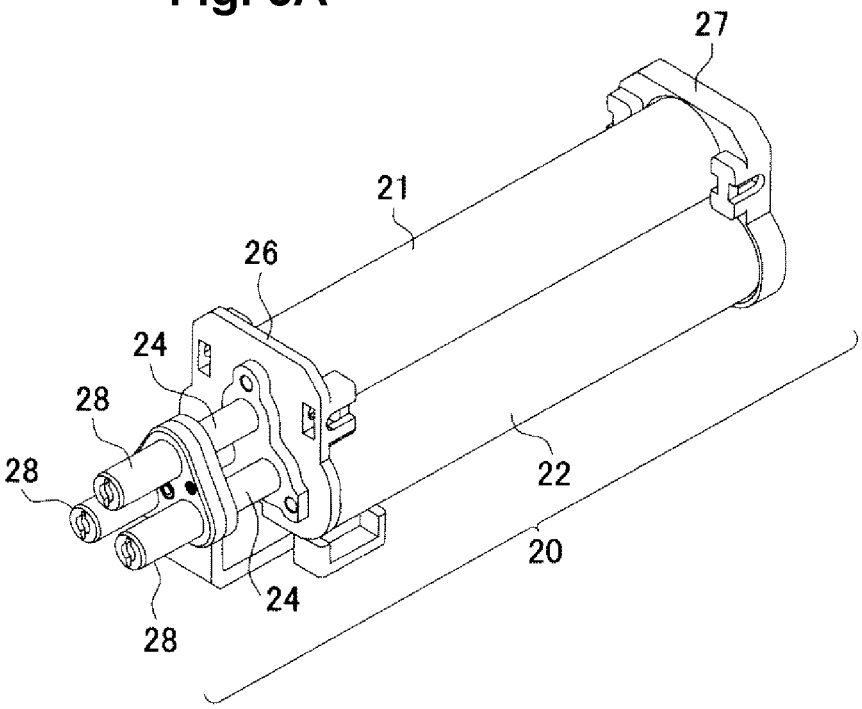
FIG. 5A is a perspective view.
Figure 5B:
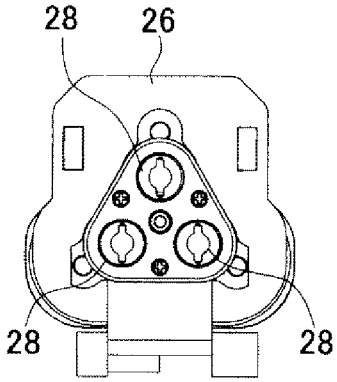
FIG. 5B is a front view.
Figure 5C:
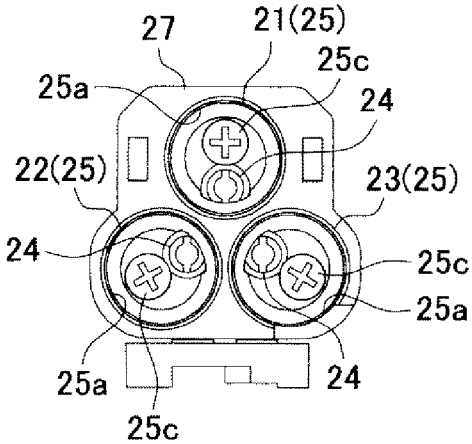
FIG. 5C is a rear view.

The air-blast nozzles 24 are provided at positions leaning to the center of the pipe members 25, 25, 25 of the three cylinders 21, 22, 23 (refer to FIG. 5). This countermeasure is provided because the air-blast nozzle 24 cannot coincide with the center of a cylinder pipe having a diameter larger than the barrel, since the number of a plurality of the barrels 11, 12, 13 in the illustrated example is three. Thus, the position of each of the air-blast nozzles 24, 24, 24 is determined based on the relationship between the barrel and the position of the center of the cylinder pipe.

Figure 6:
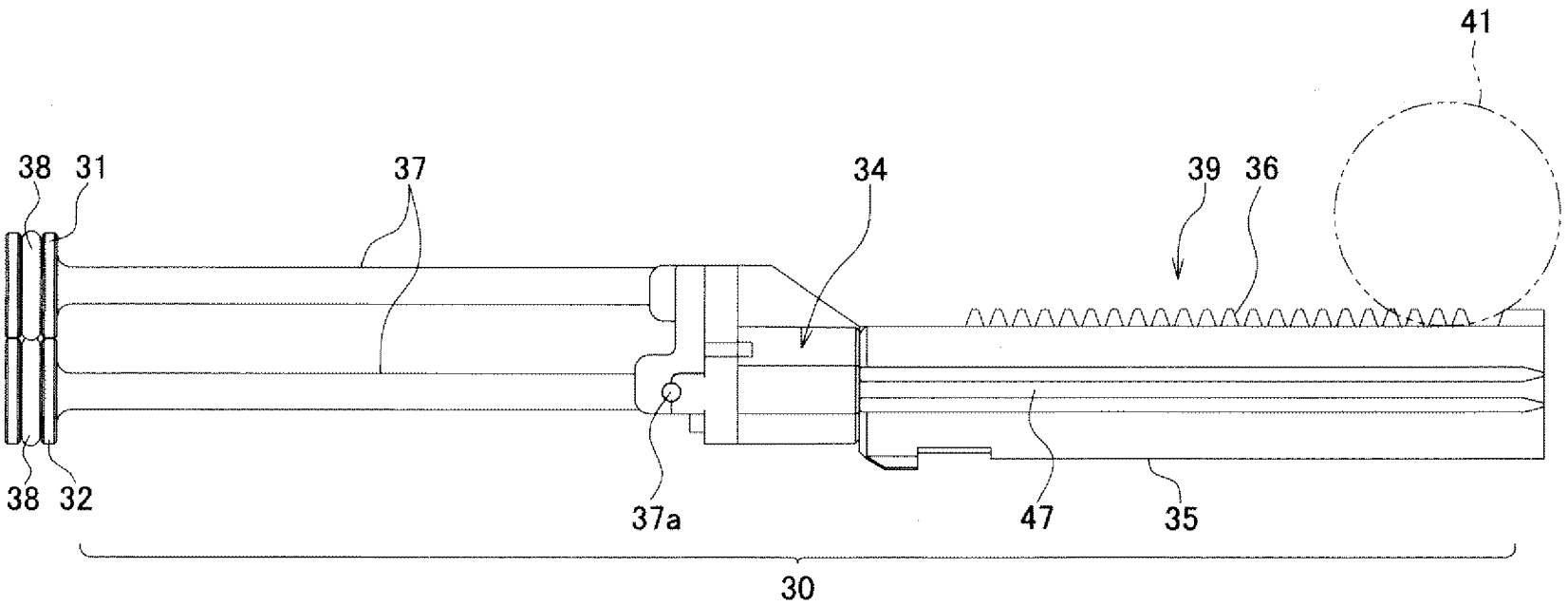
FIG. 6 is a side view illustrating the piston assembly according to the invention.

The piston assembly 30 has the three pistons 31, 32, 33 which respectively reciprocate inside the cylinders 21, 22, 23 and generate compressed air. In addition, the three pistons 31, 32, 33 are configured to be bound in one place by a joint portion 34 at the rear and to be integrally provided with one piston shaft 35 having a rack 36 along a reciprocating direction and the joint portion (refer to FIG. 6).

The three pistons 31, 32, 33 are flexibly joined to the joint portion 34 such that seal performance between the pistons 31, 32, 33 and cylinder inner wall surfaces is maintained due to the joined state. That is, when the pistons and the cylinders configuring a piston cylinder-mechanism have high precision in the positional relationship or the fitting state therebetween, it becomes easy to obtain high compressibility. Moreover, the axial centers therebetween also have to coincide with each other with high precision. However, when a certain degree of flexibility is allowed, it is possible to obtain high compressibility without requiring excessive precision.

In order to apply the flexibility, the present invention adopts a configuration in which the pistons 31, 32, 33 are respectively provided at the tip ends of slender rods 37, 37, 37, so that each of the rods 37 is movably pivoted in the joint portion 34 at the rear. In the illustrated embodiment, each of the rods 37 is pivoted with respect to the piston reciprocating direction by using a pivot 37*a* in the transverse direction. For example, all the rods 37 are configured to be movable in the vertical direction. The air-tightness of the pistons 31, 32, 33 is maintained by using the illustrated O-rings as seal members 38.

In the configuration of the embodiment in which the piston cylinder mechanism is constituted by three sets, as described above, the three sets are combined in the piston assembly 30 so as to have a triangle shape when seen from the front, the piston shaft 35 is disposed in the joint portion 34 with a positional relationship of being shifted downward from a central portion of the three sets, and the rack 36 is positioned at the top of a part which is shifted downward. Therefore, the position of the rack 36 becomes close to the central portion of the three sets. Accordingly, it is possible to gain a disposition space 39 for the electric mechanism 40 of an output gear 41, and driving force of the output gear 41 is more efficiently transmitted from a position close to the center line.

Figure 7:
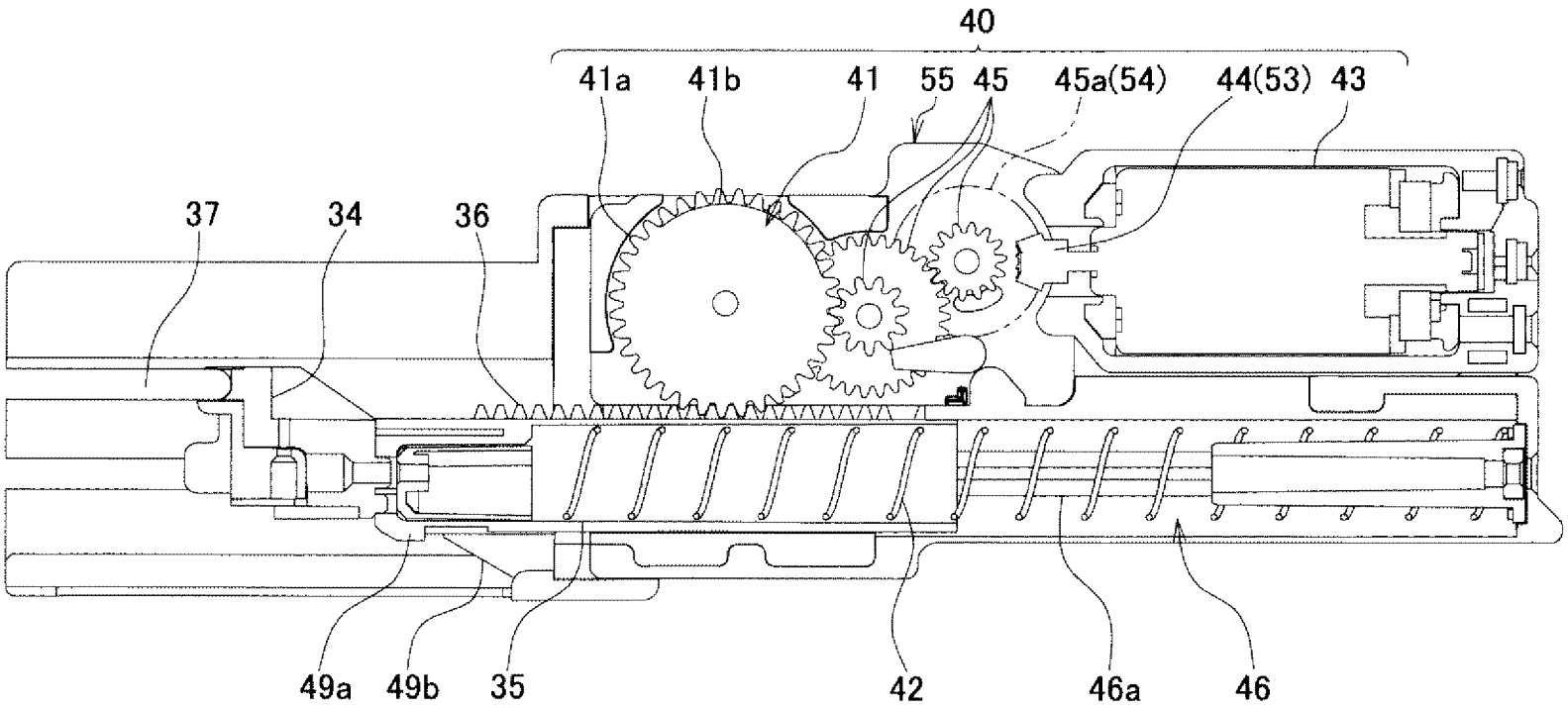
FIG. 7 is a view illustrating a part from the piston assembly to an electric mechanism according to the invention.

The electric mechanism 40 is configured to cause the piston assembly 30 to retract, to cause an elastic member 42 to accumulate pressure, and to drive the sector gear 41 meshing with the rack 36 in order to compress air by releasing the accumulated pressure. As a description with reference to FIG. 7, the reference sign 43 indicates an electric motor, that is, a motor holder, the reference sign 44 indicates a pinion attached to a rotary shaft thereof, and the reference sign 45 indicates a reduction gear set constituted by several gears meshing with the pinion 44. The sector gear 41 has a gear in a portion of the circumference. The sector gear 41 has a toothed portion 41*a* which meshes with the rack 36 and causes the piston assembly 30 to retract, and a non-toothed portion 41*b* which does not mesh with the rack 36 and enables the piston assembly 30 to advance.

The piston shaft 35 has a hollow structure and is biased in the advancing direction by the elastic member 42 illustrated as a coil spring which is hollow inside. One end of the elastic member 42 constituted by the coil spring is in contact with the front end of the piston shaft which is hollow inside, and the other end is supported by the rear end of the cavity which is a piston movement portion 46 provided inside the electric mechanism 40. The reference sign 47 indicates a guide portion constituted by an irregular structure. The guide portion 47 is provided in a laterally longitudinal direction of the piston shaft 35 and engages with a projection 46*a* which is an engagement counterpart constituted by an irregular structure provided on the gun main body side, thereby functioning as a guide for moving straight forward.

In addition to the description above, the multi-bullet shooting electric gun G according to the present invention includes mechanisms required for operating as an electric gun, such as a power source battery (not illustrated), a circuit connecting the power source battery and the motor holder 43, and a switch for turning on and off the power source. The reference sign 18 indicates the switch, the reference sign 19 indicates an outer barrel housing the three barrels, the reference sign 48 indicates a selector for selecting a shooting mode, the reference sign 52 indicates a selector lever for operation, and the reference sign 49 indicates the aforementioned latch member. The latch member 49 is pivoted at the rear end of the nozzle base 29 by a pivot 29*a* as vertically movable engagement means. The latch member 49 is configured to be retractable by being engaged with an engagement counterpart portion 49*a* provided in the piston shaft 35 and to be able to be disengaged by coming into contact with a disengagement portion 49*b* provided on the gun main body side. The reference sign 49*c* is a spring, which is means biasing the latch member 49 in a direction for engaging with the engagement counterpart portion 49*a* (refer to FIG. 2). The spring 29*b* is configured to act on the nozzle base 29 as forward biasing means so as to push out the supplied bullet B to the cartridge portion 14.

In the present invention, the displacement system for a motor attachment angle is further embedded in which the attachment angle between an output gear 53 of the motor holder 43 configuring the electric mechanism 40 and an input gear 54 of a gear box 55 is displaceable. In the embodiment, the output gear 53 is the pinion 44 constituted by a small-diameter bevel gear provided in an output axis of the motor holder 43, and the input gear 54 is a first gear 45*a* of the reduction gear set 45 constituted by a large-diameter bevel gear (refer to FIG. 7).

Figure 8:
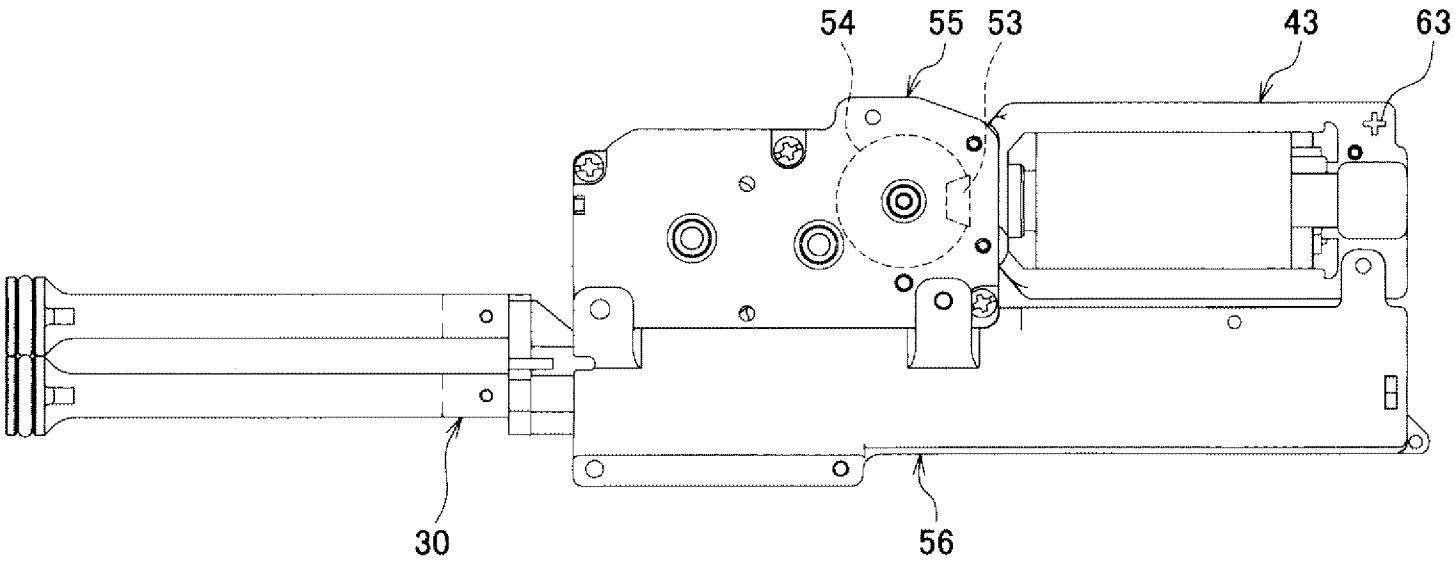
FIG. 8 is a side view illustrating an example of the displacement system for a motor attachment angle according to the invention.
Figure 9:
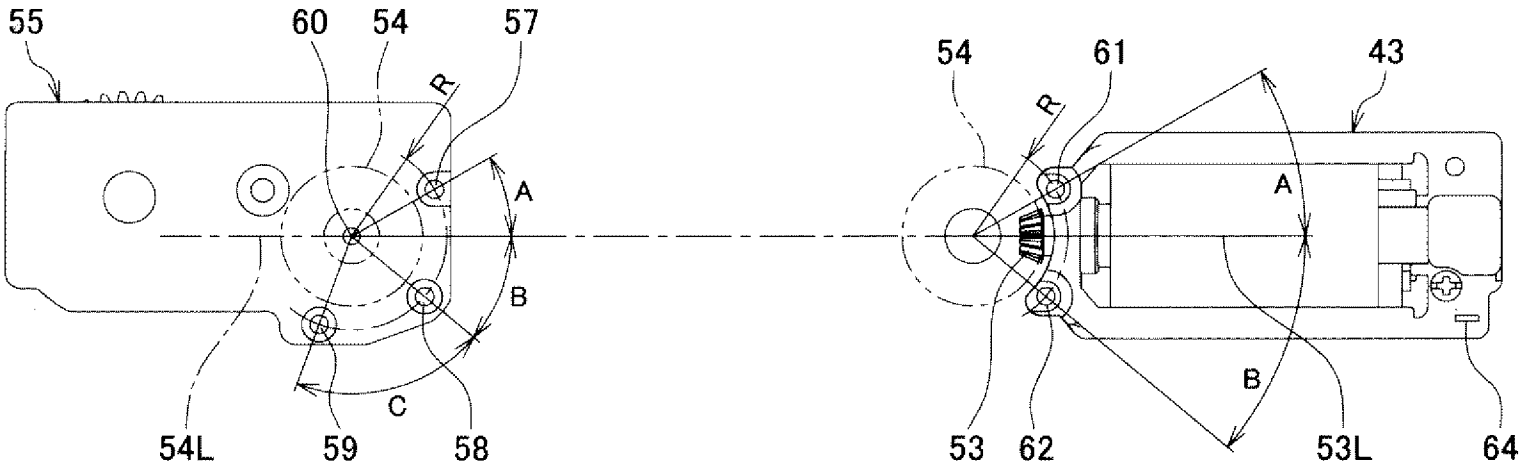
FIG. 9 is a view illustrating a relationship required between a motor holder and a gear box in the displacement system according to the invention.

The motor holder 43 and the gear box 55 are assembled in a piston cover 56 (refer to FIG. 8) and are assembled by using a bolt or a pin so as to be able to be individually divided. The displacement system illustrated in FIG. 8 is fitted in the electric gun G of the embodiment. The motor holder 43 and the gear box 55 are disposed in a higher level than the piston cover 56. However, in consideration of the form seen in the simulation gun, it is considered to be more general to have a form in which the motor holder 43 and the gear box 55 are disposed in a lower level than the piston cover 56. Therefore, in the description of FIG. 9 and thereafter, descriptions will be given regarding a general form which FIG. 9 is a view illustrating a relationship required between the output gear 53 of the motor holder 43 and the input gear 54 of the gear box 55 in the present invention. The output gear 53 is provided at the tip end of an output axial line 53L extending out from the motor holder 43, and the direction of the output axial line 53L coincides with the axial line of the motor holder 43 in the longitudinal direction. The input gear 54 is provided on the rear end side of the gear box 55. The direction of an axial line 54L in the longitudinal direction passing through a rotary shaft 60 of the input gear 54 coincides with the axial line of the gear box 55 in the longitudinal direction and is orthogonal to the rotary shaft 60. Therefore, the output gear 53 and the input gear 54 are configured to mesh with each other via a right-angle axis.

Connection portions 57, 58 are provided in an least two places on the gear box 55 side. Connection counterpart portions 61, 62 are provided in two places on the motor holder 43 side under a positional relationship of respectively coinciding with the connection portions 57, 58. In the configuration, the connection portions 57, 58 are on the same circumference about the rotary shaft 60 of the input gear 54 and on both sides across the radial-directional axial line 54L passing through the rotary shaft 60 of the input gear 54, and angles A, B formed by the axial line respectively connecting the connection portions 57, 58 and the rotary shaft 60 of the input gear 54, and the radial-directional axial line 54L are not equal to each other (A≠B). Sometimes, the connection portions 57, 58 in two places will be called the first connection portion and the second connection portion.

Figure 10A:
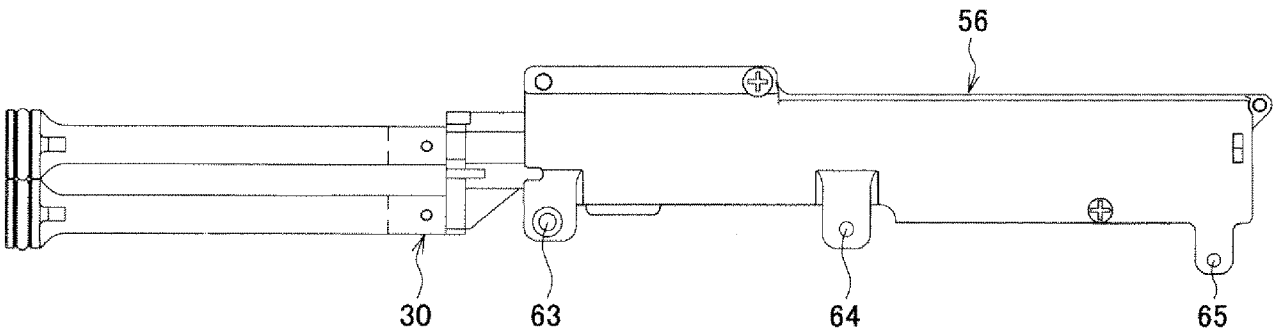
FIG. 10A is a side view illustrating the piston assembly.
Figure 10B:
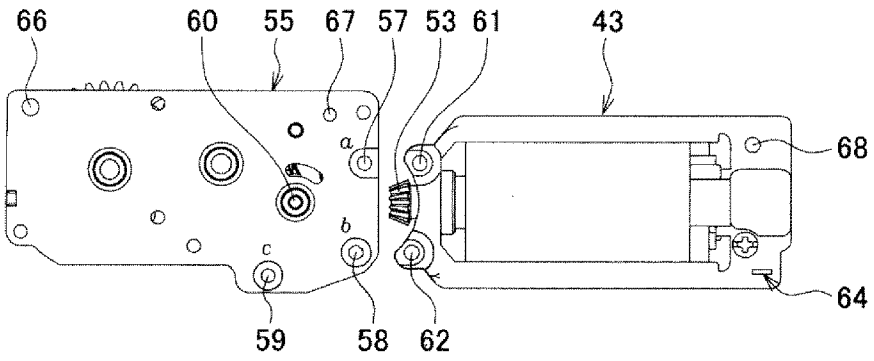
FIG. 10B is a side view illustrating a form of the motor holder and the gear box.
Figure 10C:
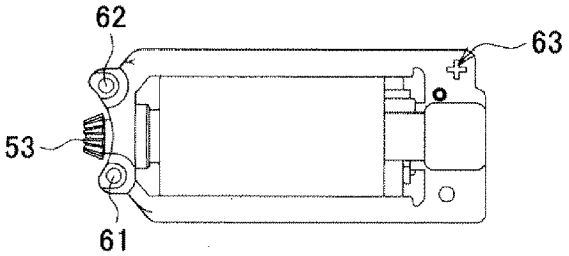
FIG. 10C is a side view illustrating the same in another form.

A specific description will be given with reference to the example of the embodiment. When the angles A, B in the motor holder 43 are the same as the angles A, B in the gear box 55 as illustrated in FIG. 9, the motor holder 43 and the gear box 55 are joined straight to each other. FIGS. 10A, 10B, and 10C illustrate combined disposition diagrams of the motor holder 43, the gear box 55, and the piston cover 56 according to the aforementioned disposition. FIGS. 10B and 10C illustrate states where the motor holder 43 is disposed upside down on the page.

The disposition in FIG. 10B is the same as the disposition in FIG. 9. The motor holder 43 and the gear box 55 are joined straight to each other (refer to FIG. 11A). In a case of being disposed upside down with respect to FIG. 10B, as in FIG. 10C, the motor holder 43 tilts downward as much as the result of the angle B−the angle A (refer to FIG. 11B). In order to indicate the orientation of the motor holder 43 between upward and downward orientations, there are provided marks 63, 64 at suitable places. In the view, the marks 63, 64 are indicated by "plus (+)" and "minus (−)". A side on which the minus mark 64 is seen indicates the straight state, and a side on which the plus mark 63 is seen indicates the tilt state.

Figure 11A:
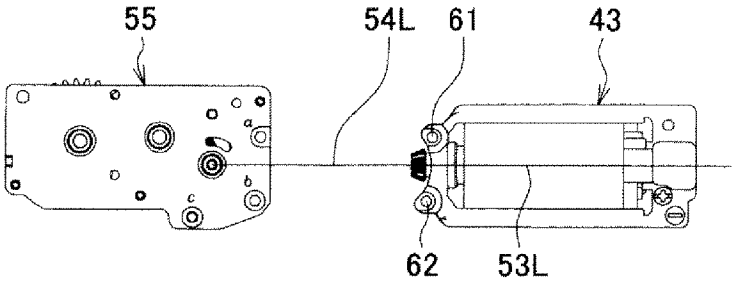
FIG. 11 consists of FIGS. 11A, 11B, 11C and 11D and is a view illustrating four forms A, B, C, and D, in which displacement of the attachment angle between the motor holder and the gear box varies, according to the invention.
Figure 11B:
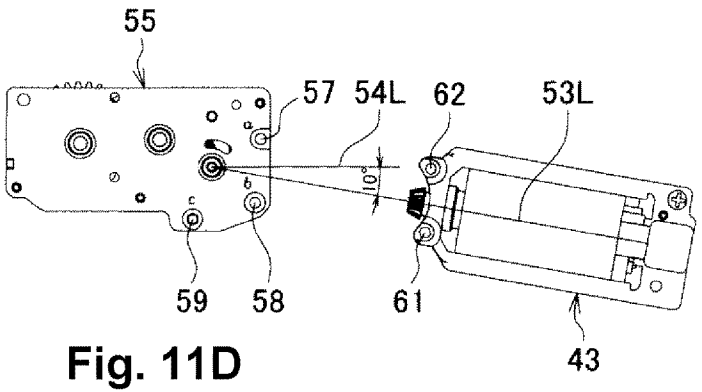
Figure 11C:
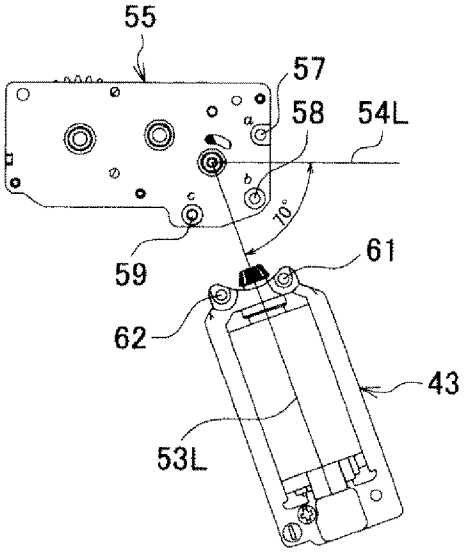
Figure 11D:
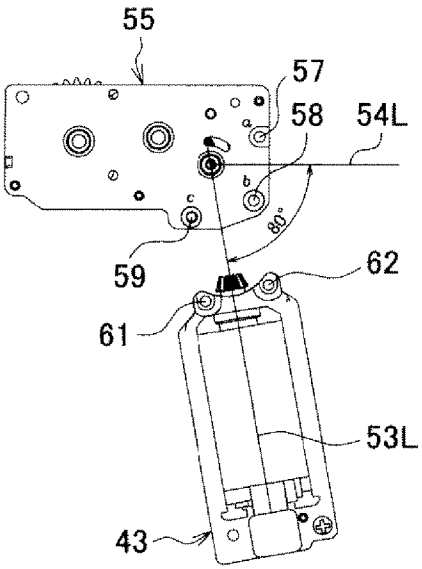

FIGS. 11C and 11D illustrate a case where a third connection portion 59 is additionally employed. As illustrated in FIG. 9, the third connection portion 59 is present on the same circumference as the connection portions 57, 58 in two places. An angle C made by an axial line connecting the third connection portion 59 and the rotary shaft 60 of the input gear 54 and the axial line connecting the second connection portion 58 and the rotary shaft 60 of the input gear 54 is equal to the sum of the angles A, B which are not equal to each other formed by the radial-directional axial lines 54L respectively connecting the first and second connection portions 57, 58 and the rotary shaft 60 of the input gear 54.

In the example, the angle A is 30 degrees, and the angle B is 40 degrees. Since FIG. 11A illustrates the joining state in FIG. 10B, the motor holder 43 and the gear box 55 are disposed in a straight line. In contrast, as illustrated in FIG. 11B, when the motor holder 43 is orientated upside down, due to the upside-down disposition of the first and second connection portions 57, 58 and the connection counterpart portion 62, 61, the motor holder 43 tilts downward as much as 10 degrees=40 degrees of the angle B−30 degrees of the angle A. In FIG. 11C, the motor holder 43 is disposed in the same manner as in FIG. 11A, and the second and third connection portions 58, 59 and the connection counterpart portions 61, 62 are respectively joined to each other, thereby tilting downward as much as 70 degrees=30 degrees of the angle A+40 degrees of the angle. In FIG. 11D, the motor holder 43 is disposed in the same manner as in FIG. 11B, and the connection portions 58, 59 and the connection counterpart portion 62, 61 are disposed upside down, thereby tilting downward as much as 80 degrees=70 degrees (A+B)+10 degrees (BA).

According to the present invention having such a configuration, as just illustrated in FIGS. 11A, 11B, 11C, and 11D, it is possible to realize four ways of the displacement system for a motor attachment angle. However, since the configurations in FIGS. 11A to 11D can also be disposed upside down, in simple calculation, the motor attachment angle can be selected in the displacement system in eight ways. As an example thereof, the displacement system for a motor attachment angle is applied to the electric gun G, and another embodiment of providing various types of simulation guns will be described below.

Figure 12A:
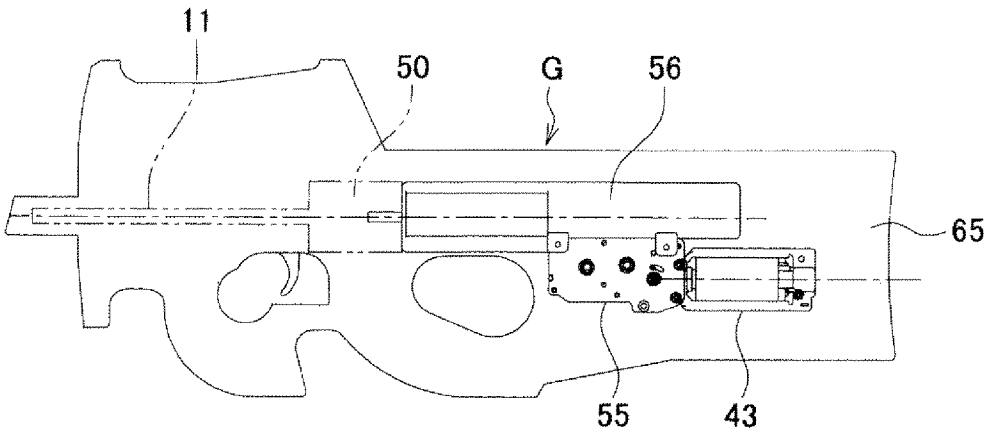
FIG. 12 consists of FIGS. 12A and 12B and is a side view illustrating two types of simulation guns A, B in each of which the displacement system according to the invention is applied in the same manner.
Figure 12B:
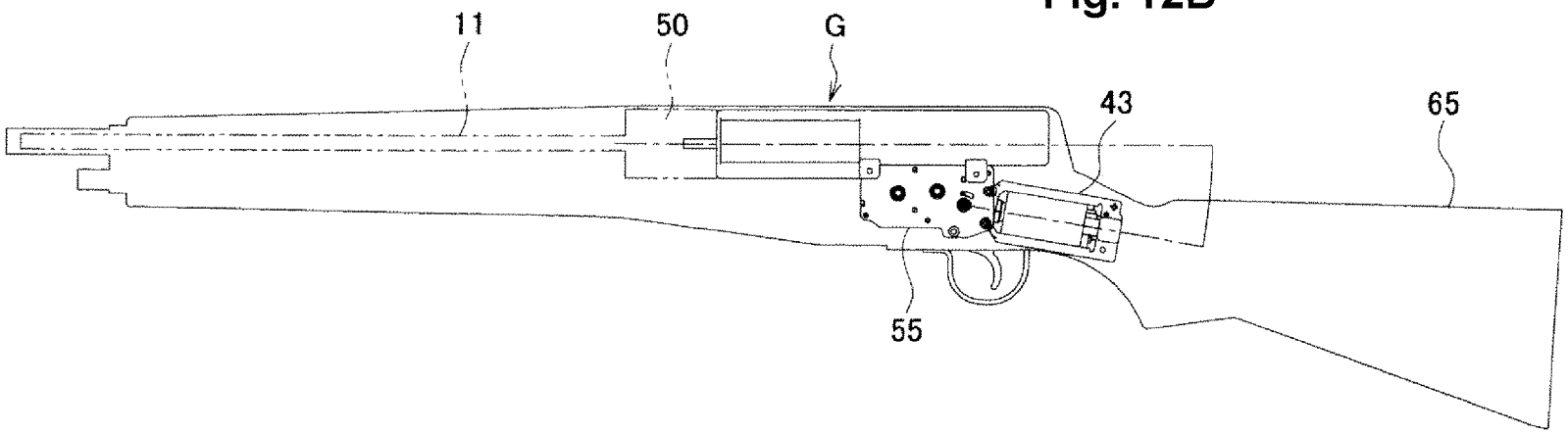

In FIG. 12A, the displacement system for a motor attachment angle according to the present invention is applied to a simulation gun G which is long substantially in only the forward-rearward direction. In this case, the motor holder 43 and the gear box 55 are horizontal and are disposed straight in the main body of the gun. FIG. 12B illustrates an example of a long barreled-type simulation gun G having a stock 65 tilting slightly downward. In this case, it is desirable to tilt downward approximately 10 degrees. Therefore, for example, it is suitable to employ the example in FIG. 11B, in which the motor holder 43 tilts downward as much as 10 degrees=40 degrees of the angle B−30 degrees of the angle A. For the configurations in common, the reference signs indicated in FIG. 1 will be incorporated herein by reference, and the detailed description will not be repeated.

Figure 13A:
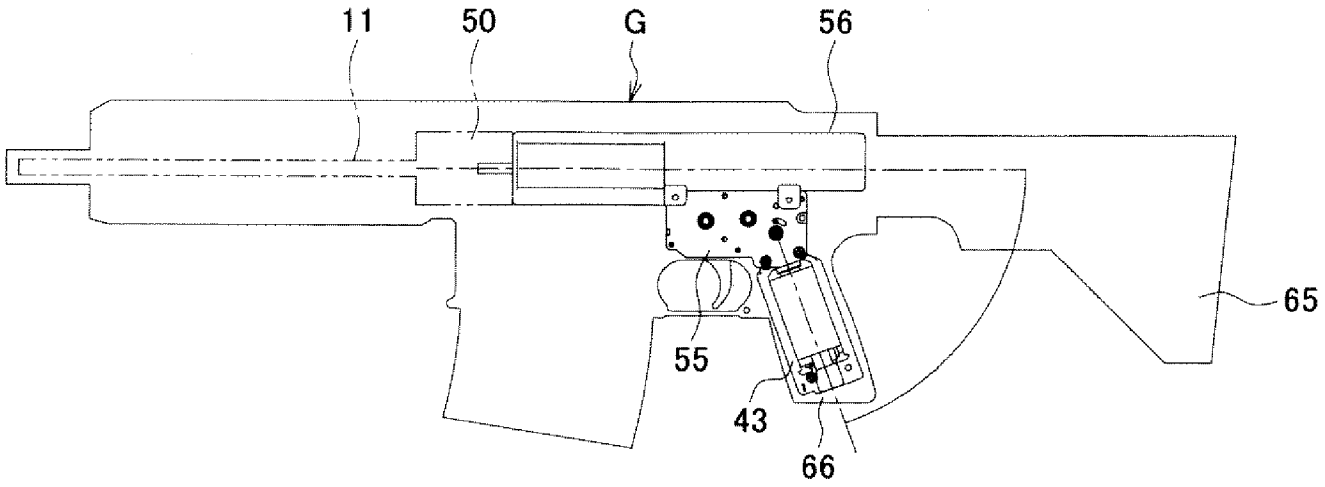
FIG. 13 consists of FIGS. 13A and 13B and is a side view illustrating another two types of simulation guns A, B in each of which the displacement system according to the invention is applied in the same manner.
Figure 13B:
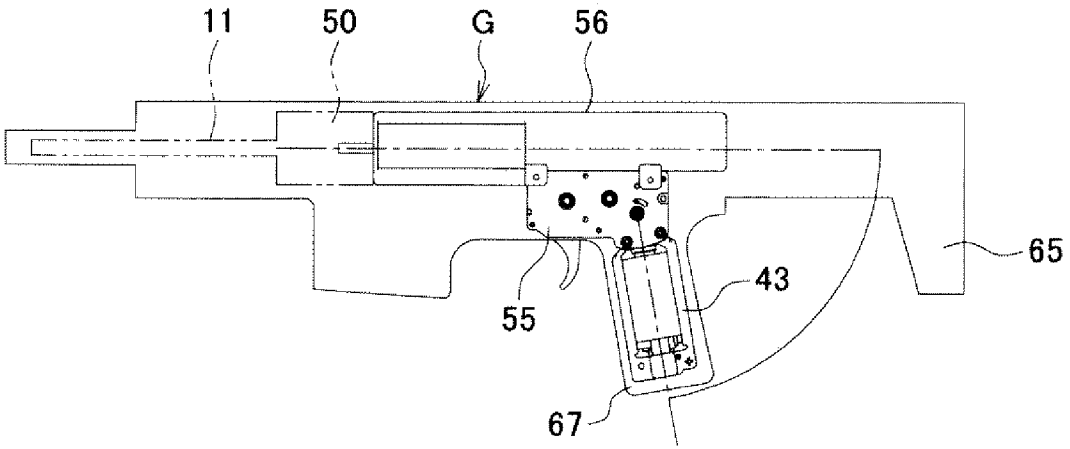

In FIG. 13A, the displacement system for a motor attachment angle according to the present invention is applied to a simulation gun G having a grip 66 which tilts rearward in a slightly significant manner. It is suitable to employ the example set in FIG. 11C, for example, in which the axial line 53L of the motor holder 43 tilts L70 degrees with respect to the axial line 54L of the gear box 55. In a case of an 8 simulation gun G having a grip 67 which tilts less than that described above, it is suitable to employ the example set in FIG. 11D, for example, in which the axial line 53L of the motor holder 43 tilts 80 degrees with respect to the axial line 54L of the gear box 55.

Figure 14A:
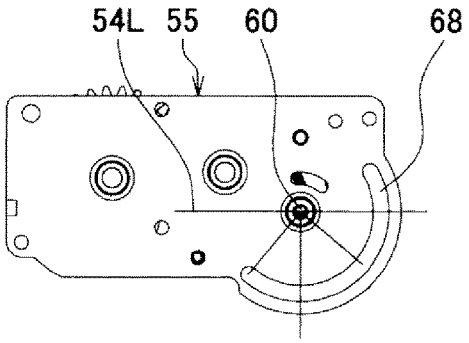
FIG. 14A is a side view illustrating a gear box.
Figure 14B:
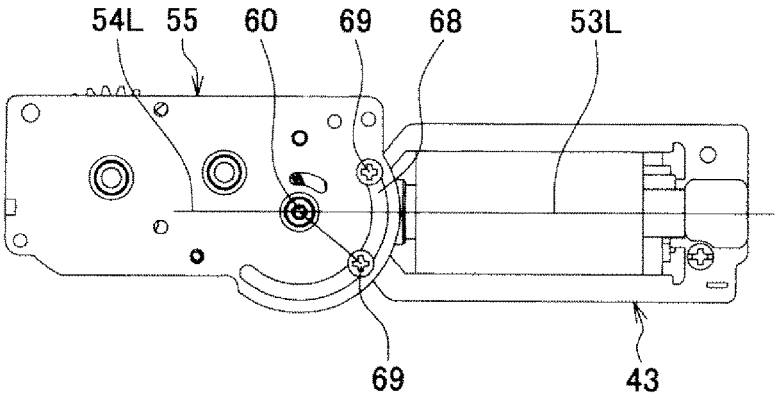
FIG. 14B is a side view illustrating Example 1 in which the gear box and a motor holder are combined.
Figure 14C:
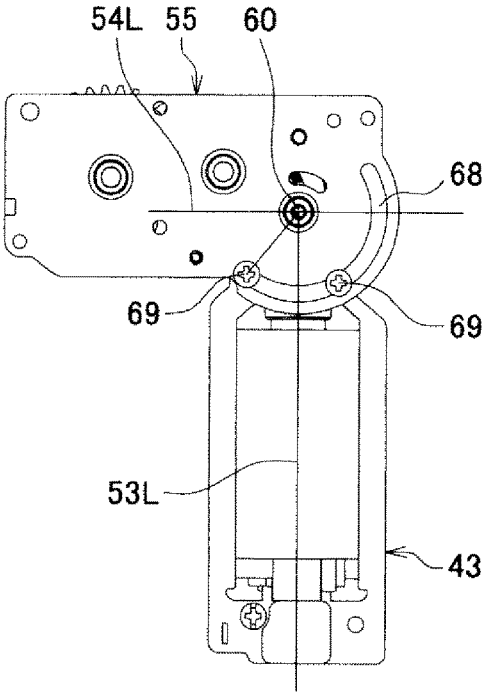
FIG. 14C is a side view illustrating Example 2 of the same combination.

Moreover, in the displacement system for a motor attachment angle according to the present invention, the connection counterpart portion is not limited to a portion such as a bolt hole, and it is possible to employ an arc-shaped connection counterpart portion 68. FIG. 12 illustrates an example thereof. The arc-shaped connection counterpart portion 68 is formed on the same circumference about the rotary shaft of the input gear in the gear box 55. The conditions required in the motor holder 43 are the same as those described above, so that the motor holder 43 can be fixed to any arbitrary position at any angle within the range of the arc-shaped connection counterpart portion 68. FIG. 14B illustrates Example 1 in which the axial line 53L of the motor holder 43 and the axial line 54L of the gear box 55 are in a horizontal axial line 53L of the motor holder 43 and the axial line 54L of the gear box 55 are perpendicular to each other, respectively. The reference sign 69 indicates fasteners illustrated as screws, which are used for joining the motor holder 43 and the gear box 55 in all the connection portions 57, 58, 59 and the connection counterpart portions 61, 62, 68.

The invention claimed is:

1. A displacement system for a motor attachment angle, in which an attachment angle between an output gear of a motor holder configuring an electric mechanism and an input gear of a gear box is displaceable, in a simulation gun in which a piston cylinder mechanism is driven by the electric mechanism and a bullet is shot with generated compressed air, wherein the output gear and the input gear are constituted by bevel gears, wherein the system comprises connection portions that are provided in at least two places on a gear box side, and connection counterpart portions that respectively coincide with the connection portions and are provided on a motor holder side, and wherein the connection portions are present on the same circumference about a rotary shaft of the input gear and on both sides across a radial-directional axial line passing through the rotary shaft of the input gear, and angles A, B formed by axial lines respectively connecting the connection portions and the rotary shaft of the input gear, and the radial-directional axial line are not equal to each other ($A \neq B$).

2. The displacement system for a motor attachment angle in a simulation gun according to claim 1, further comprising:

a third connection portion that serves as another connection portion, wherein the third connection portion is present on the same circumference as connection portions in two places, and an angle C made by an axial line connecting the third connection portion and the rotary shaft of the input gear and the axial line connecting a second connection portion and the rotary shaft of the input gear is equal to a sum of the angles A, B which are not equal to each other formed by the radial-directional axial lines respectively connecting a first connection portion and the second connection portion and the rotary shaft of the input gear.

3. The displacement system for a motor attachment angle in a simulation gun according to claim 1, wherein the connection counterpart portion is an arc-shaped connection counterpart portion which is formed in a gear box on the same circumference about the rotary shaft of the input gear, and the motor holder is able to be fixed at an arbitrary position in the arc.

* * * * *